US011933064B2

(12) United States Patent
Lynn Brouwers et al.

(10) Patent No.: US 11,933,064 B2
(45) Date of Patent: Mar. 19, 2024

(54) PORTABLE WIND-RESISTANT SHADE STRUCTURE

(71) Applicants: Andrea Lynn Brouwers, Forestville, CA (US); Robert Brouwers, Forestville, CA (US)

(72) Inventors: Andrea Lynn Brouwers, Forestville, CA (US); Robert Brouwers, Forestville, CA (US)

( * ) Notice: Subject to any disclaimer, the term of this patent is extended or adjusted under 35 U.S.C. 154(b) by 0 days.

(21) Appl. No.: 17/867,993

(22) Filed: Jul. 19, 2022

(65) Prior Publication Data

US 2023/0026166 A1 Jan. 26, 2023

Related U.S. Application Data

(60) Provisional application No. 63/251,637, filed on Oct. 3, 2021, provisional application No. 63/223,546, filed on Jul. 20, 2021.

(51) Int. Cl.

| | |
|---|---|
| ***E04H 15/44*** | (2006.01) |
| ***E04H 15/54*** | (2006.01) |
| ***E04H 15/58*** | (2006.01) |
| ***E04H 15/60*** | (2006.01) |
| *E04H 15/00* | (2006.01) |

(52) U.S. Cl.

CPC ..... *E04H 15/44* (2013.01); *E04H 15/54* (2013.01); *E04H 15/58* (2013.01); *E04H 15/60* (2013.01); *E04H 15/005* (2013.01)

(58) Field of Classification Search

None

See application file for complete search history.

(56) References Cited

U.S. PATENT DOCUMENTS 1,820,002 A * 8/1931 Forrester ..... E04H 15/44 135/147
2,891,491 A 6/1959 Richter
(Continued)

FOREIGN PATENT DOCUMENTS

GB 2 414 250 A1 11/2005
KR 10 2019 0115863 A1 10/2019
(Continued)

OTHER PUBLICATIONS

Extended Search Report for co-pending European Patent Application No. EP 22185800 dated Dec. 9, 2022.
(Continued)

*Primary Examiner* — David R Dunn
*Assistant Examiner* — Danielle Jackson
(74) *Attorney, Agent, or Firm* — TMB Law; Timothy M. Brown

(57) ABSTRACT

The invention provides a portable, free-standing shade structure that is resistant to wind. The inventive shade structure can comprise a frame and a sheet, or canopy, that is connected to the frame under tension at two or more different heights to create an uneven, hypar conformation in the sheet. The uneven, hypar conformation of the sheet transfers wind force to the frame so as to press the frame against the surface upon which the shade structure rests, thereby making the inventive shade structure resistant to the movement, tipping, lift, and vibration that typically results when a portable shade structure is exposed to wind.

14 Claims, 11 Drawing Sheets

(56) References Cited

U.S. PATENT DOCUMENTS

| | | | | | |
|---|---|---|---|---|---|
| 2,928,405 | A * | 3/1960 | Lawson | E04H 15/44 | D25/56 |
| 3,060,949 | A * | 10/1962 | Moss | E04H 15/58 | D25/56 |
| 3,327,723 | A * | 6/1967 | Burgin | E04H 15/44 | 135/147 |
| D233,745 | S | 11/1974 | Sumner | | |
| 4,367,761 | A * | 1/1983 | Winant | E04H 15/18 | 135/87 |
| 4,882,884 | A * | 11/1989 | Browne | E04H 15/644 | 52/645 |
| 5,234,011 | A * | 8/1993 | Lynch | E04H 15/58 | 135/114 |
| 5,477,876 | A * | 12/1995 | Moss | E04H 15/26 | 135/97 |
| 5,566,701 | A * | 10/1996 | Grey | E04H 15/58 | 135/98 |
| 5,622,197 | A * | 4/1997 | Valaire | E04H 15/58 | 114/106 |
| 5,918,614 | A * | 7/1999 | Lynch | E04H 15/54 | 135/114 |
| 6,055,999 | A * | 5/2000 | Grey | E04H 15/322 | 135/147 |
| D530,433 | S | 10/2006 | Haymann | | |
| D530,434 | S | 10/2006 | Haymann | | |
| 7,219,681 | B1 * | 5/2007 | Hamilton-Jones | E04H 15/44 | 135/123 |
| D544,104 | S * | 6/2007 | Grotbeck | D25/56 | |
| D562,426 | S | 2/2008 | Goldsmith | | |
| D578,597 | S * | 10/2008 | Dalland | D21/837 | |
| D591,820 | S * | 5/2009 | Dalland | D21/837 | |
| D599,873 | S | 9/2009 | Dalland | | |
| D622,412 | S | 8/2010 | McCarthy | | |
| D625,025 | S | 10/2010 | Colmore-Williams | | |
| D628,309 | S | 11/2010 | Adams | | |
| D628,711 | S | 12/2010 | Mathis | | |
| D628,712 | S | 12/2010 | Mathis | | |
| 8,757,187 | B2 * | 6/2014 | Kiefer | F16C 11/0623 | 135/117 |
| 8,776,816 | B2 * | 7/2014 | Danziger | E04H 15/48 | 135/147 |
| D727,452 | S * | 4/2015 | Yang | D21/837 | |
| D746,041 | S * | 12/2015 | Lin | D3/5 | |
| 10,081,965 | B2 * | 9/2018 | Warner | E04B 7/102 | |
| 10,465,316 | B2 * | 11/2019 | Bagwell | D04B 21/16 | |
| D896,988 | S | 9/2020 | Keithley | | |
| D896,989 | S | 9/2020 | Madden | | |
| D897,560 | S | 9/2020 | Keithley | | |
| 11,174,655 | B2 * | 11/2021 | Graindlair | E04H 15/58 | |
| 11,530,549 | B1 * | 12/2022 | Rice | E04H 15/18 | |
| 2003/0034061 | A1 * | 2/2003 | Warner | E04H 15/34 | 135/144 |
| 2004/0134141 | A1 * | 7/2004 | Hebbelinck | E04H 15/18 | 52/223.1 |
| 2004/0261953 | A1 | 12/2004 | Hart | | |
| 2007/0062567 | A1 * | 3/2007 | Warner | E04H 15/18 | 135/97 |
| 2007/0248407 | A1 * | 10/2007 | Huang | E04H 15/44 | 403/389 |
| 2009/0308422 | A1 * | 12/2009 | Rizzotto | E04H 15/44 | 135/121 |
| 2013/0174889 | A1 * | 7/2013 | Dalland | H02S 20/22 | 211/41.1 |
| 2017/0363131 | A1 | 12/2017 | Pena | | |
| 2023/0077674 | A1 | 3/2023 | Pan | | |

FOREIGN PATENT DOCUMENTS

| | | | |
|---|---|---|---|
| NZ | 401554-0001 | S | 3/2001 |
| NZ | 401682-0001 | S | 5/2001 |
| NZ | 405189-0001 | S | 9/2004 |

OTHER PUBLICATIONS

Co-pending Design U.S. Appl. No. 29/785,239, filed May 25, 2021.
Co-pending Design U.S. Appl. No. 29/884,220, filed Feb. 8, 2023.
Coolaroo Website; Pergolas & Gazebos: https://www.coolaroousa.com/category/pergolas-gazebos (accessed May 22, 2023).
Coolaroo Website; Butterfly Gazebo: https://www.coolaroousa.com/product/butterfly-gazebo (accessed May 22, 2023).

* cited by examiner

PORTABLE WIND-RESISTANT SHADE STRUCTURE

CROSS-REFERENCE TO RELATED APPLICATIONS

This application claims the benefit of provisional application No. 63/251,637, filed Oct. 3, 2021, and provisional application No. 63/223,546, filed Jul. 20, 2021. The entire contents of these applications are incorporated herein by reference for all purposes.

FIELD OF THE INVENTION

The invention is in the field of shade structures and shelters for protection from the elements.

BACKGROUND OF THE INVENTION

Known portable shade structures typically contain a frame, roof portion or canopy, and optionally walls. One example of such a structure is the white tents that are typically used for outdoor gatherings, catered events, and outside of dining establishments. Structures such as white tents saw a significant increase in use in restaurant settings when the COVID pandemic restricted restaurants to serving customers exclusively outside. While known portable shade structures, such as white tents, provide an option for a temporary, moveable source of shade and shelter, they are unstable in wind and impractical for use during even moderate wind events.

Permanent shade structures and shelters are also available in the art. However, these options require significant construction, such as the use of backhoes and concrete for providing sufficient anchoring of the structures' supporting pillars. Thus, permanent shade structures require a significant amount of time and are costly to install. This makes them an impractical solution when a shade structure is needed quickly or for only a short period, or unknown period of time. Moreover, permanent shade structures and shelters are impractical for installation on sidewalks and parking lots, such as outside of eating establishments. Additionally, the construction of permanent shade structures often requires a complicated, lengthy permitting process that further increases the cost and time required for their installation.

Also known in the art are shade structures that must be reinforced or supported by their attachment to other structures, such as buildings or RV's, for example. These structures and shelters can take on the form of awnings which are not free-standing. Thus, these structures are limited in where they can be used since they must be affixed to a supporting structure. These structures can lack stability in the wind.

What is needed in the art therefore is a portable, free-standing shade structure that is resistant to wind and can be put to use quickly on a temporary or permanent basis without significant construction or the need for obtaining complicated regulatory permits.

The above and other features, aspects and advantages of the present invention will become better understood from the following description of non-exhaustive embodiments of the invention, provided with reference to the accompanying drawings. Each embodiment is provided to illustrate the invention, not as a limitation of its scope. In fact, it will be apparent to those skilled in the art that various modifications and variations can be made to the illustrated embodiments without departing from the inventive concept embodied therein. For instance, features illustrated or described as part of one embodiment can be used with another embodiment to yield a still further embodiment. Such variations and modifications are not excluded from forming part of the invention, unless technically senseless, merely because they are not explicitly described.

SUMMARY OF THE INVENTION

The inventors surprisingly discovered and developed a portable, free-standing shade structure that is stable in wind. The inventive shade structure can be installed quickly without the need for significant construction or complicated regulatory permits, and without being affixed to, or stabilized by, another structure. The wind-resistant properties of the inventive shade structure further make the structure capable of complying with code regulations that require threshold levels of wind stability.

In some aspects of the invention, the shade structure comprises a frame having interconnected pillars and cross members, and a sheet that is connected to the frame in a manner that produces an uneven, planar surface in the sheet. Without being limited to any particular theory or mechanism, the uneven planar surface in the sheet transfers wind forces to the frame to provide an anchoring force that stabilizes the shade structure against the surface upon which the shade structure rests. The inventive shade structure achieves the uneven, planar surface in the sheet through its unique arrangement of pillars of alternating heights.

In another aspect, the invention provides a frame for a shade structure that permits one or more canopies on the shade structure to assume an aesthetic parabolic shape, such as a hypar, for example. Unlike known shade structures that have canopies with parabolic or hypar shapes, the inventive shade structure is portable and does not require the installation of permanently affixed columns and footings which must be dug into the earth, and in some instances, fixed in concrete. The frame of the inventive shade structure is made portable through the use of fittings and attachments that permit the frame components to detachably connect to one another, and optionally to the surface upon which the shade structure rests.

It is therefore an object of the invention to provide a portable, wind-resistant shade structure, comprising: a frame having a plurality of pillars connected to a plurality of cross members; and a sheet connected to the frame, wherein the sheet is connected to the frame at two or more different heights to produce an uneven planar surface in the sheet.

In some aspects, the sheet is connected to the frame under tension.

In some aspects, the uneven planar surface is in the shape of a hypar.

In some aspects, the cross members are detachably connected to one another.

In some aspects, the cross-members are connected to one another at a center of the frame.

In some aspects, each of the cross members has a first end and a second end, wherein the first ends are connected to the plurality of pillars, and the second ends are connected one another.

In some aspects, the second ends are connected to one another by a connecting body.

In some aspects, the pillars are detachably connected to the cross members.

In some aspects, the sheet is connected to the pillars.

In some aspects, the sheet connects to the pillars at or near the tops of the pillars.

In some aspects, the pillars have at least two different heights.

In some aspects, the pillars comprise a first pair of pillars having a first height, and a second pair of pillars having a second height.

In some aspects, the pillars are not connected to a guy-line.

In some aspects, one or more of the pillars are connected to a first anchor.

In some aspects, the first anchor is fixed to a surface.

In some aspects, the first anchor comprises a weighted body.

In some aspects, one or more of the cross members are connected to a divider panel.

In some aspects, the divider panel is connected to the one or more cross members by hook-and-loop fasteners, magnets, screws, snaps, loops, zip-ties, or combinations thereof.

In some aspects, the sheet comprises at least one sidewall portion.

In some aspects, the at least one sidewall portion is connected to a second anchor.

In some aspects, the at least one sidewall portion is connected to the second anchor in line with a perimeter of the frame or outside the perimeter of the frame.

In some aspects, the second anchor is fixed to a surface.

In some aspects, the second anchor comprises a weighted body.

In some aspects, each of the pillars comprises a top portion that extends from the pillars at an angle.

In some aspects, the sheet is connected to the top portions.

In some aspects, the sheet comprises an opening at or near a center of the sheet.

Figure 1:
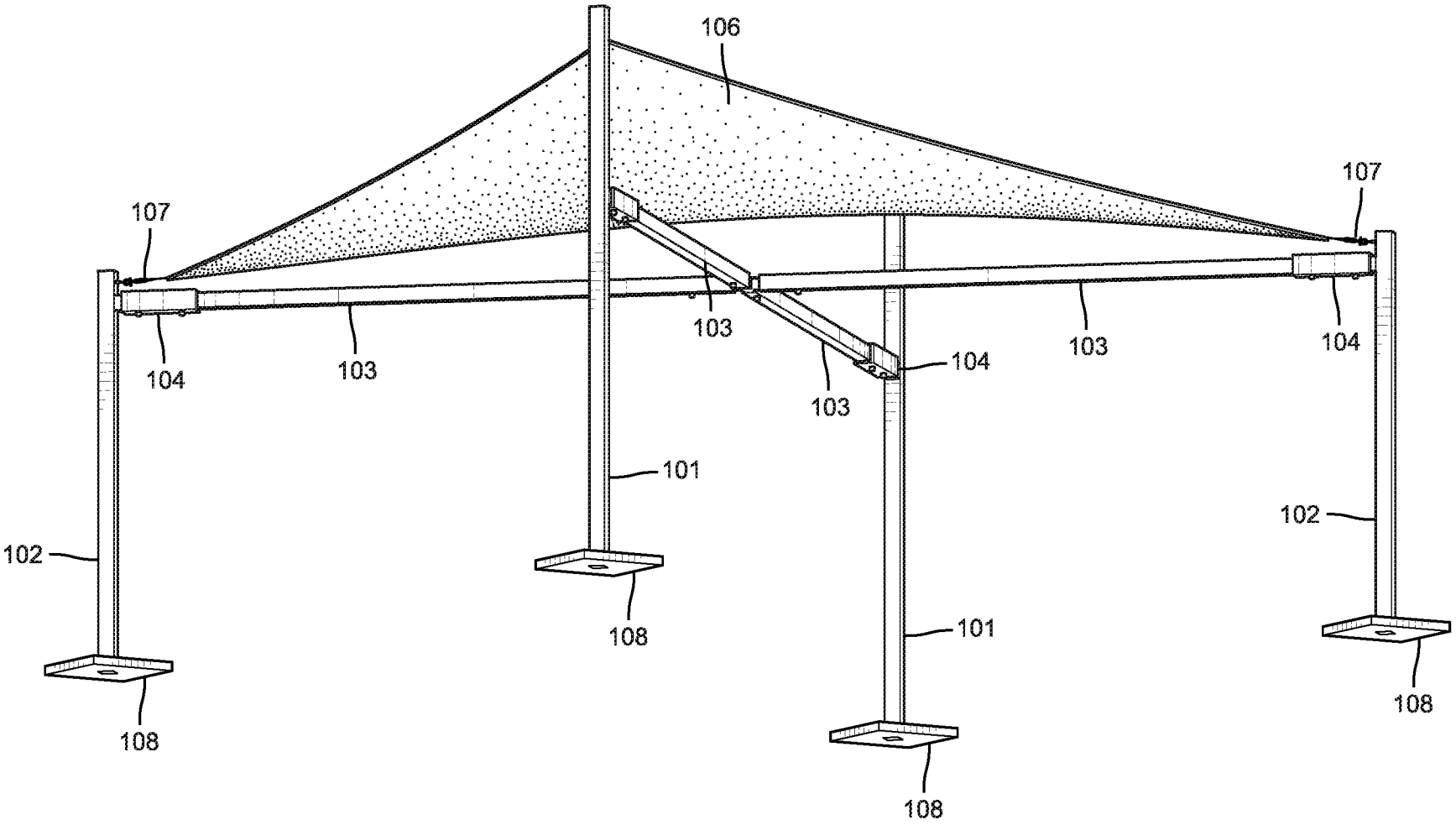
FIG. 1 is a perspective view of an embodiment of the inventive shade structure.

The figures referred to above are not drawn necessarily to scale and should be understood to present a representation of the invention, illustrative of the principles involved. Some features of the shade structure depicted in the drawings have been enlarged or distorted relative to others to facilitate explanation and understanding. The same reference numbers are used in the drawings for similar or identical components and features shown in various alternative embodiments. The shade structure, as disclosed herein, will have configurations and components determined, in part, by the intended application and environment in which it is used.

DETAILED DESCRIPTION

The invention provides a portable, free-standing shade structure that is resistant to wind. Without being limited to any particular theory or mechanism, the invention accomplishes its unique free-standing, wind-resistant utility by connecting a sheet to a frame so as to produce an uneven, planar surface in the sheet that transfers wind force from the sheet to the frame in a manner that stabilizes the frame against the surface upon which the shade structure rests.

FIG. 1 shows an embodiment of the inventive shade structure comprising frame 100 having pillars 101 and pillars 102. Pillars 101 can be greater in height than pillars 102 and can be arranged to produce pillars of alternating heights. Pillars 101 and pillars 102 are connected to cross members 103, and cross members 103 are connected to one another. Pillars 101 and pillars 102 can connect to cross members 103 through any detachable connection that permits the pillars and cross members to be firmly fixed to one another so as to provide strength and rigidity to frame 100, while permitting their assembly and disassembly. In some embodiments, pillars 101 and pillars 102 detachably connect to cross members 103 by joint connection 104 so as to permit the inventive shade structure to be assembled and disassembled, thereby making the inventive shade structure portable. Alternatively, pillars 101 and pillars 102 can connect to cross members 103 by a permanent means, such as by welding, for example. Cross members 103 can detachably connect to one another by connecting body 105 to similarly permit the assembly and disassembly of the frame. In a non-limiting embodiment, cross members 103 connect to one another over a frame center as disclosed herein.

Pillars 101, pillars 102, cross members 103, and connecting body 105 can be hollow, tubular members having a cross section that is circular, oblong, triangular, square, rectangular, or other polygonal shape. In some non-limiting embodiments, pillars 101, pillars 102, and cross members 103 have a square cross section. Pillars 101, pillars 102, cross members 103, and connecting body 105 can have a cross-sectional width that is about 2 inches, about 3 inches, or about 4 inches. In a non-limiting embodiment, pillars 101, pillars 102, and cross members 103 have a cross-sectional width that is 3.5 inches. Suitable materials for pillars 101, pillars 102, cross-members 103, joint connection 104, and connecting body 105 include, but are not necessarily limited to, metals, metal alloys (e.g. steel), fiberglass, and carbon fiber, for example.

Configuring frame 100 wherein cross members 103 connect to one another in the center of the frame can provide a number of advantages. The configuration can provide strength to the frame so as to permit sheet 106 to connect to pillars 101 and 102 under tension without the tops of the pillars being pulled inward and otherwise twisting the frame. Thus, sheet 106 is permitted to be connected to pillars 101 and 102 in a manner that permits sheet 106 to assume its hypar, wind-resistant shape. Connecting cross members 103 in the center of frame 100 can also distribute the weight of the frame towards its center thereby increasing the inventive shade structure's stability in the wind. Connecting cross members 103 in the center of the frame can also permit the cross members to be provided in a shorter length than if the cross members were to be positioned around the perimeter of the frame. This increases the portability of the inventive shade structure by avoiding frame components having greater lengths.

Sheet 106 can connect to frame 100 by connections 107. Connections 107 can comprise, for example, eye nuts, through bolts, cables, rope, wire, twine, shackles, turnbuckles, or combinations thereof. In a non-limiting embodiment, sheet 106 is stretched and connected to frame 100 under tension. In some embodiments, pillars 101 are greater in height than pillars 102, and sheet 106 is connected at or near the top of pillars 101 and pillars 102. As used herein, the term "near" refers to a distance that is between about 1 inch and about 24 inches from the article that is referenced. For example, connecting sheet 106 near the top of pillars 101 and 102 means sheet 106 is connected to the pillars at a distance that is between about 1 inch and about 24 inches from the top of the pillars. As used herein, the term "about" means the value or quantity that is referenced, or that varies, plus or minus, by up to 5%, up to 10%, or up to 15% of the referenced value or quantity. Connecting sheet 106 to frame 100 at different heights produces in sheet 106 an uneven, planar shape. In some embodiments, the uneven, planar shape is a hypar shape. As used herein, the term "hypar" refers to saddle-shaped structures, including, but not limited to hyperbolic paraboloids and shapes that are not pure hyperbolic paraboloids.

Without wishing to be bound by any theory or mechanism, the uneven, planar shape of sheet 106 makes the inventive shade structure resistant to wind by permitting sheet 106 to transfer wind forces to frame 100, resulting in frame 100 being forced against the surface upon which the shade structure rests. The uneven, planar shape of sheet 106 can make the inventive shade structure resistant to 45 mile-per-hour winds. As used herein, the phrase "resistant to wind" refers to the ability of the inventive shade structure to avoid lateral movement (e.g. sliding), vibration, lift, and tipping of the shade structure as a result of being exposed to wind. Being resistant to wind, the inventive shade structure can be free-standing without its frame being connected or secured to another structure or device, such as buildings, RVs, guy-lines, or permanently grounded pillars or columns, for example. While embodiments of the inventive shade structure contemplate frame 100 being free standing without any connection to a surface or adjacent object, it will be appreciated that the inventive shade structure can be fixed to a surface upon which it rests, as well as adjacent objects.

While the figures herein depict frame 100 as having four pillars with two different heights, it will be appreciated that frame 100 can assume any number of pillars and pillar heights that produce an uneven, planar configuration (e.g. hypar shape) in sheet 106. For example, frame 100 can comprise three, four, five, six, or more pillars having two or more different heights, wherein sheet 106 is connected to, or near the top of, the pillars. In an alternate embodiment, frame 100 can comprise three, four, five, six, or more pillars having the same height, wherein sheet 106 is connected to the pillars at two or more different heights to produce a hypar shape in sheet 106. It will also be appreciated that sheet 106 can be connected to frame 100 at two or more different heights by connecting sheet 106 to a combination of pillars and cross members. For example, sheet 106 can connect to one or more cross members at or near where the corresponding cross member connects to a pillar, while other portions of sheet 106 connect to one or more other pillars at a height that is above the cross members.

In some embodiments, one or more of pillars 101 and pillars 102 are connected to anchors 108. Anchors 108 can comprise weighted bodies that are adapted to help further secure the inventive shade structure on the surface on which it rests. The weighted body can be, for example, one or more steel plates, or other weighted material, such as concrete slabs or blocks, for example. In other embodiments, anchors 108 are plates having holes therein for fixing anchors 108 to a surface by fasteners, such as screws, anchor bolts, earth anchors, and the like. Pillars 101 and 102 and anchors 108 can be configured to be fixed to surfaces such as concrete, pavement, tile, wood decking, composite decking, rubber tiles, poured-in rubber surfacing, soil, lawn, Astroturf™, or combinations thereof.

Figure 2:
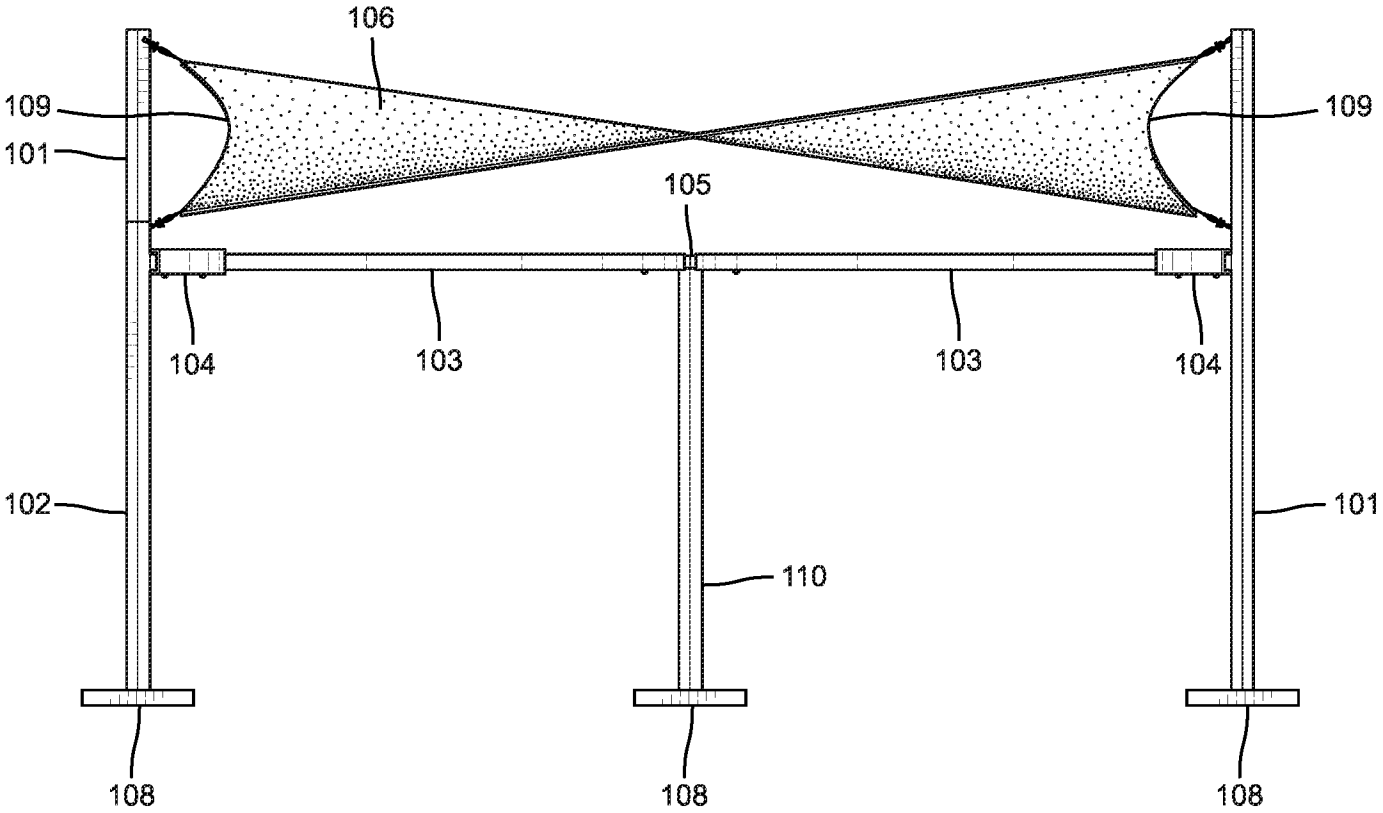
FIG. 2 is a side view of an embodiment of the inventive shade structure.

FIG. 2 shows a side view of an embodiment of the inventive shade structure. The left side of FIG. 2 depicts pillar 102 in front of pillar 101, with the top portion of pillar 101 being visible as pillars 101 are greater in height than pillars 102. On the right side of FIG. 2, pillar 101 obscures the view of pillar 102 as pillars 102 are shorter than pillars 101. Sheet 106 is shown connected to pillars 101 and pillars 102 by connections 107 under tension such that sheet 106 assumes a hypar shape. As shown in FIG. 2, connecting sheet 106 to frame 100 under tension can produce one or more arcs in sheet edge 109. Sheet 106 can be cut to a dimension such that it has one, two, three, four, or more arcs in sheet edges 109 when sheet 106 is connected to frame 100 under tension. In some embodiments of the invention, frame 100 can comprise center support 110 connected to connecting body 105. Center support 110 can be adapted to provide support against the downward force of the weight of connecting body 105 and cross members 103. Center support 110 can be a tubular or solid body having a cross section that is circular, oblong, triangular, square, rectangular, or other polygonal shape. In some preferred embodiments, center support 110 has a square cross section. Suitable materials for center support 110 include, but are not necessarily limited to, metals, metal alloys, fiberglass, and carbon fiber, for example.

Figure 3:
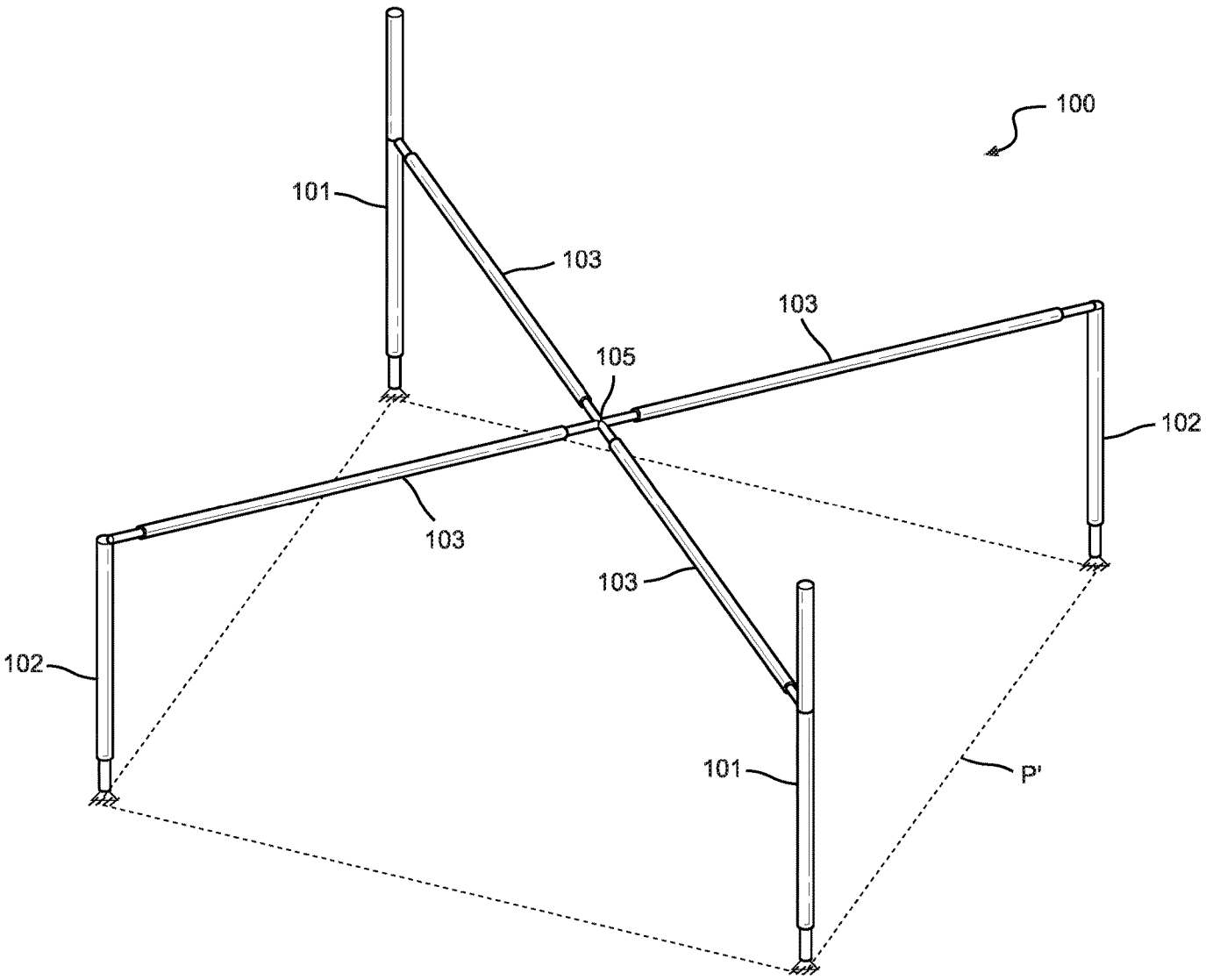
FIG. 3 shows a frame for use with an embodiment of the inventive shade structure.

The pillars of the inventive shade structure can define the perimeter of the shade structure frame, wherein the perimeter constitutes a continuous line drawn in a horizontal plane between adjacent pillars. For example, referring to FIG. 3, pillars 101 and pillars 102 can define perimeter P' as a square. As disclosed herein, the inventive shade structure can comprise three, four, five, six, or more pillars. Thus, the perimeter of the frame can assume perimeter shapes including, but not necessarily limited to, triangular, quadrilateral, pentagonal, hexagonal, heptagonal, octagonal, and the like. The perimeter can be a quadrilateral shape that is a square, rectangle, trapezium, trapezoid, isosceles trapezoid, rhombus, or parallelogram, for example. Perimeter P' can assume any dimension that provides a desired footprint of shade and shelter from the elements. Some non-limiting dimensions for perimeter P' include, but are not necessarily limited to square perimeters that are about 12 feet by about 12 feet, square perimeters that are about 20 feet by about 20 feet, square perimeters that are about 28 feet by about 28 feet, and rectangular perimeters that are about 16 feet by about 20 feet. The perimeter of the frame can define a frame center, wherein the frame center is in the middle of the horizontal plane of the geometric shape defined by the frame's pillars.

Figure 4:
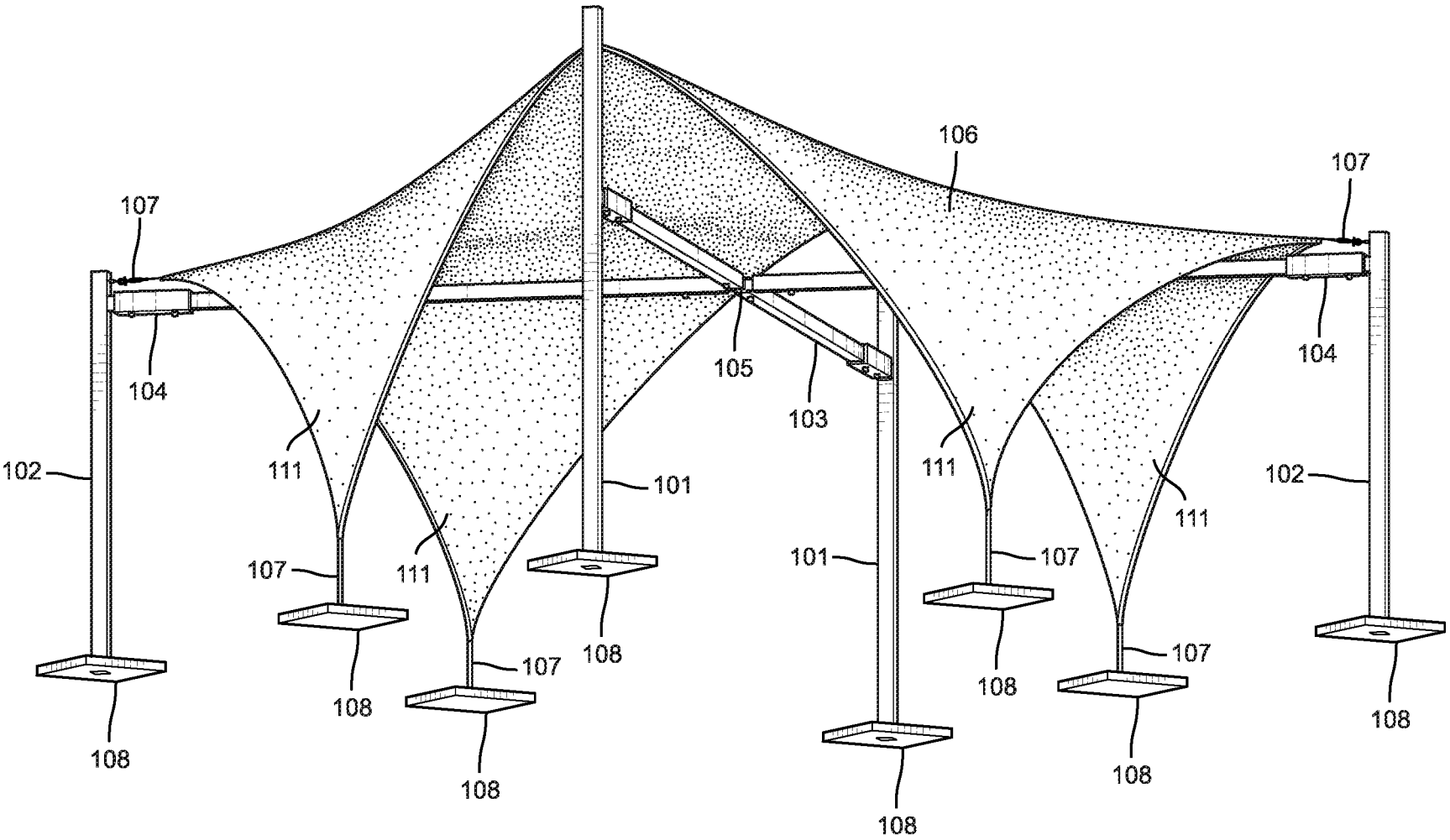
FIG. 4 is a perspective view of an embodiment of the inventive shade structure featuring a sheet having sidewall portions.

In some embodiments, the sheet 106 comprises sidewall portions 111. Sidewall portions 111 can provide additional protection from the sun, wind and rain. FIG. 4 shows an embodiment of the inventive shade structure wherein sheet 106 comprises sidewall portions 111 descending downward toward the surface upon which the shade structure rests. Sidewall portions 111 can vary in length and width such that sidewall portions 111 have an area that is about 20%, about 30%, about 40%, about 50%, about 60%, about 70% or about 80% of the plane that is defined between the pillars where the sidewall portion is located, with the top of the plane being coextensive with cross members 103, and the bottom of the plane being defined by a surface on which the shade structure rests.

Figure 5:
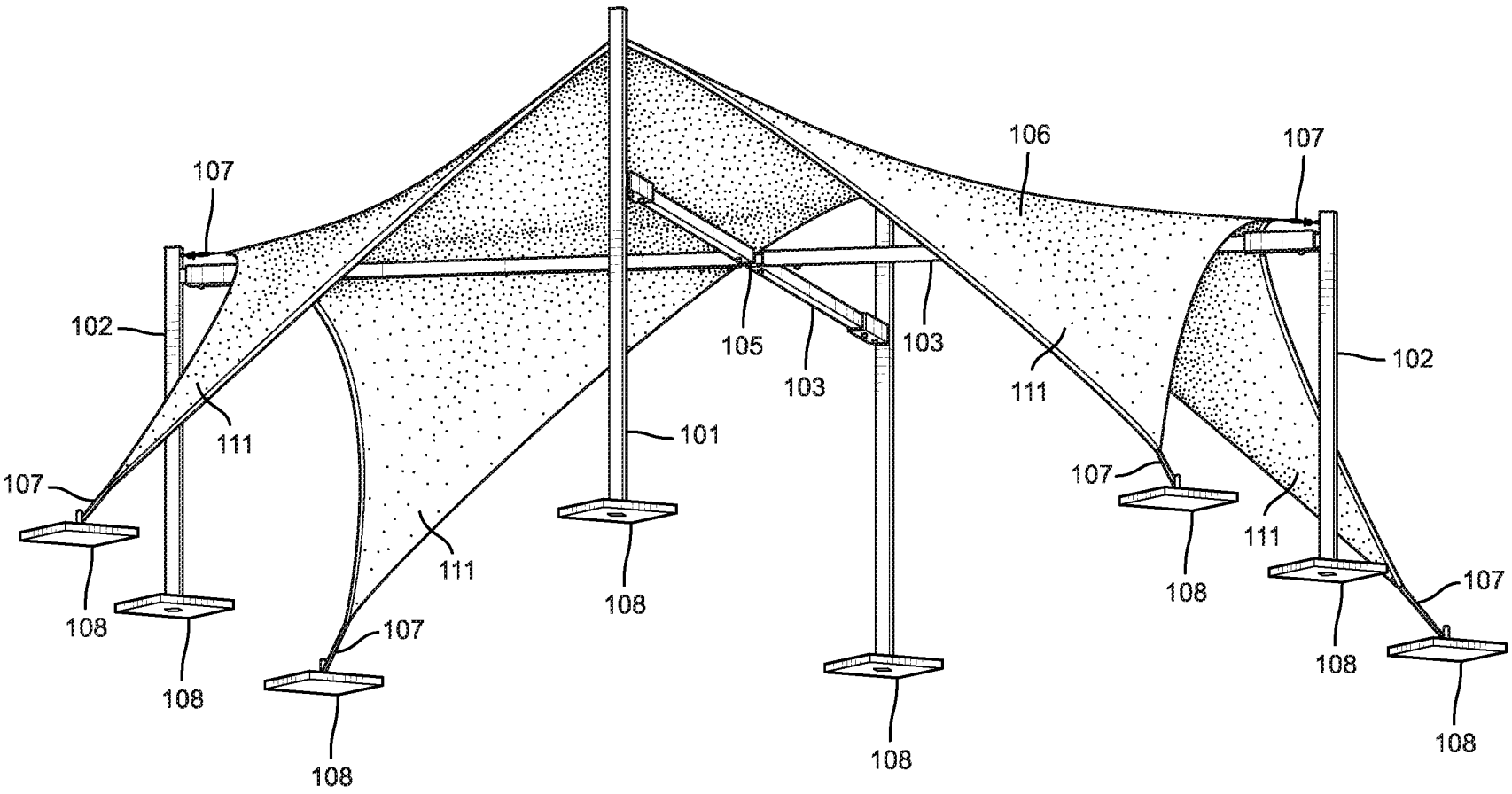
FIG. 5 is a perspective view of an alternate embodiment of the inventive shade structure featuring a sheet having sidewall portions.

In a non-limiting embodiment, sidewall portions 111 assume a generally triangular configuration. The inventive shade structure can comprise one, two, three, four, or more sidewall portions 111. Sidewall portions 111 can connect to anchors 108. Sidewall portions 111 can connect to anchors 108 under tension. Sidewall portions 111 can connect to anchors 108 by connections 107, for example. Sidewall portions 111 can connect to anchors 108 such that sidewall portions 111 extend straight down in line with the perimeter frame 100, or outside the perimeter of frame 100 at an angle, or a combination thereof. FIG. 4 depicts an embodiment of the inventive shade structure wherein sidewall portions 111 connect to anchors 108 in line with the perimeter of the frame, while FIG. 5 depicts an embodiment of the inventive shade structure wherein sidewall portions 111 connect to anchors 108 at an angle and outside the perimeter of the frame. Sidewall portions 111 can connect to anchors 108 at a distance that is up to about nine feet outside the perimeter of the frame. In an alternate embodiment, sidewall portions 111 connect directly to the surface upon which the shade structure rests, such as by anchor bolts or earth anchors, for example. In another non-limiting embodiment, sidewall portions 111 connect to an object, such as a building, fence, retaining wall or other wall, post, pergola, RV, or tree, for example. In such embodiments, the sidewall portion can connect to the object at a height that is less than, the same as, or greater than the height cross members 103. Sidewall portions 111 can be connected to anchors 108, the surface on which the shade structure rests, adjacent objects, or a combination thereof. Sidewall portions 111 can be connected to anchors 108, the surface on which the shade structure rests, or adjacent objects by connections 107. In a non-limiting embodiment, sidewall portions 111 connect to a surface, such as soil or lawn, wherein anchors 108 are earth anchors.

Figure 6:
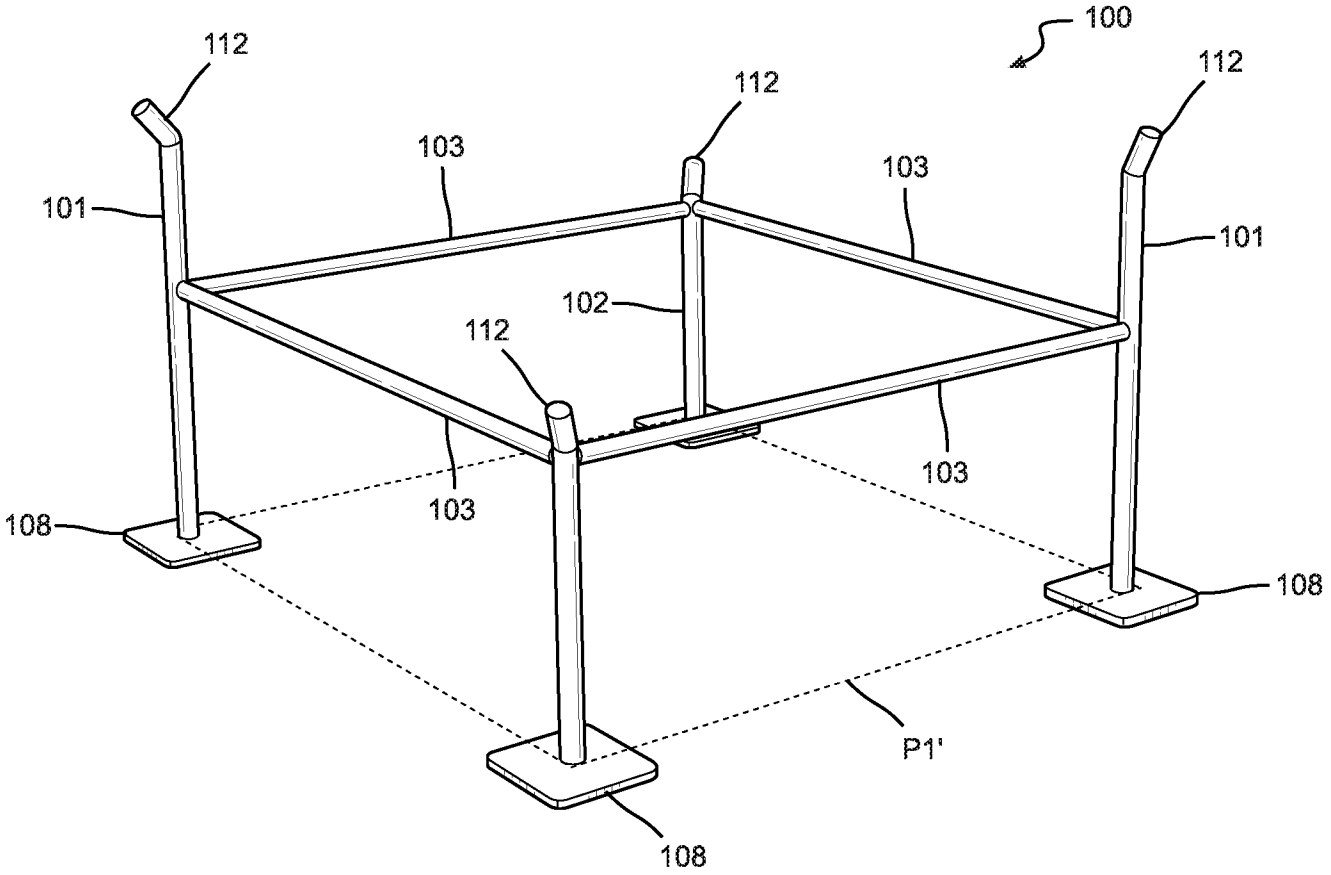
FIG. 6 shows a frame for an embodiment of the inventive shade structure.

In some embodiments, the frame of the inventive shade structure assumes a configuration wherein cross members 103 do not connect to one another. FIG. 6 depicts a non-limiting embodiment of the inventive shade structure wherein frame 100 has cross members 103 connected between adjacent pillars 101 and 102. For example, pillars 101 and 102 can be connected to one another by cross-members 103 along perimeter P'. Cross members 103 can connect to pillars 101 at a distance below the top of pillars 101, while cross members 103 connect to pillars 102 at a distance from the top of pillars 102. Alternatively, cross members 103 can connect at, or near the top of, both pillars 101 and pillars 102. Cross members 103 can connect to pillars 101 and 102 by any rigid, detachable connection suitable for providing strength and rigidity to frame 100. For example, cross members 103 can connect to pillars 101 and 102 by joint connection 104. Alternatively, cross members 103 can connect to pillars 101 and 102, by welding, for example.

Still referring to FIG. 6, frame 100 can incorporate extensions 112 at the tops of pillars 101 and 102 so as to permit sheet 106 to connect to the pillars at a distance that is outside perimeter P'. Connecting sheet 106 to pillars 101 and 102 outside perimeter P' can permit sidewall portions 111 to connect to anchors 108 without sidewall portions 111 contacting cross-members 103. Extensions 112 can extend from pillars 101 and 102 at an angle that is between about 113 degrees and about 157 degrees as measured from the longitudinal axes of pillars 101 and 102. In one non-limiting embodiment, extensions 112 extend from pillars 101 and 102 at an angle of about 135 degrees. Extensions 112 can be connected to pillars 101 and 102 by any rigid connection means, such as welding or in a sleeve relationship, for example. Alternatively, extensions 112 can be an integral portion of pillars 101 and 102, wherein extensions 112 are formed by bending a portion of the ends of pillars 101 and 102. It will be understood that sheet 106 can connect to extensions 112 in the same or similar manner as the connection of sheet 106 to pillars 101 and 102, such as by connections 107 as disclosed herein.

Figure 7:
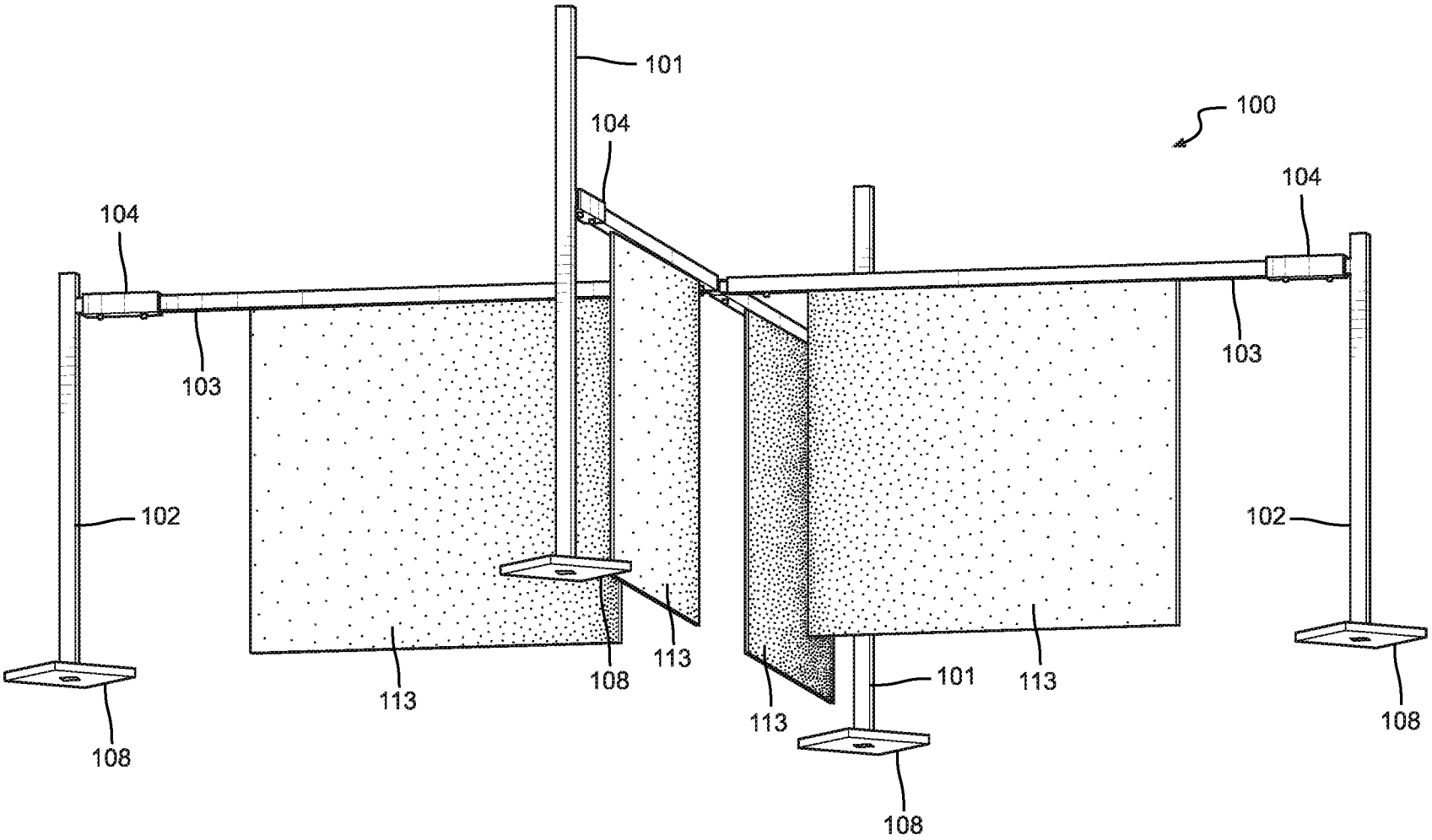
FIG. 7 is a perspective view of an embodiment of the inventive shade structure having divider panels.

FIG. 7 shows an embodiment of the inventive shade structure wherein divider panels 113 are connected to cross members 103. The inventive shade structure can comprise one, two, three, four, or more divider panels 113. Divider panels 113 can have a width that spans up to about 20%, 50%, 60%, 70%, 80%, 90% or 100% of the length of the cross member to which the divider panel connects. Divider panels 113 can connect to cross members 103 by any connection that allows divider panels 113 to be suspended from cross members 103. Divider panels 113 can connect to cross members 103 by connections including, but not necessarily limited to, hook-and-loop fasteners (e.g. Velcro™), magnets, screws, snaps, loops (e.g. loops made of fabric, string, cord, twine, wire, or other suitable material), zip-ties, or combinations thereof. Divider panels 113 can function to section off the inventive shade structure so as to provide privacy or isolation when the shade structure is used for multiple groups of occupants, such as in connection with the providing of restaurant and bar services outdoors. Isolation of occupants can provide a particular advantage in helping prevent the spread of contagious infections, such as COVID. Thus, divider panels 113 can permit a restaurant, bar, or other hospitality business to remain open when regulations require that groups of patrons be served outdoors and separated from one another.

It will be appreciated that the inventive shade structure can comprise side panels on one or more sides of the structure. The side panels can be connected between pillars 101 and 102 to provide additional protection from the sun, wind, and rain. The side panels can be a sheet material that covers at least a portion of the area between pillars 101 and pillars 102. The sheet material can be a material that is used for sheet 106 and divider panels 113, as disclosed herein. The side panels can connect to pillars 101 and pillars 102 along at least a portion of the lateral edges of the side panels. The side panels can connect to pillars 101 and pillars 102 by any connection suitable for attaching a sheet-like material to pillars 101 and pillars 102. Suitable connections for connecting the side panels to pillars 101 and pillars 102 include, but are not necessarily limited to, hook-and-loop fasteners (e.g. Velcro™), magnets, screws, snaps, loops (e.g. loops made of fabric, string, cord, twine, wire, or other suitable material), zip-ties, or combinations thereof. In a non-limiting embodiment, the side panels connect to sheet 106 along the top edge of the side panels.

The lateral edges of the side panels can have a length that is about the same as, or less than, the pillar to which the side panel connects. For example, the lateral edge that connects to pillar 101 can have the same length as pillar 101, while the lateral edge that connects to pillar 102 can have the same length as pillar 102. In such an arrangement, the top edge of the side panel tapers from pillar 101 towards pillar 102 due to pillar 102 being shorter in height than pillar 101. The bottom edge of the side panels can be straight across the bottom. When connected to pillars 101 and 102, the bottom edge of the side panel can be flush with the surface upon which the shade structure rests, or can be between about 1 inch and about 24 inches above the surface upon which the shade structure rests.

Figure 8:
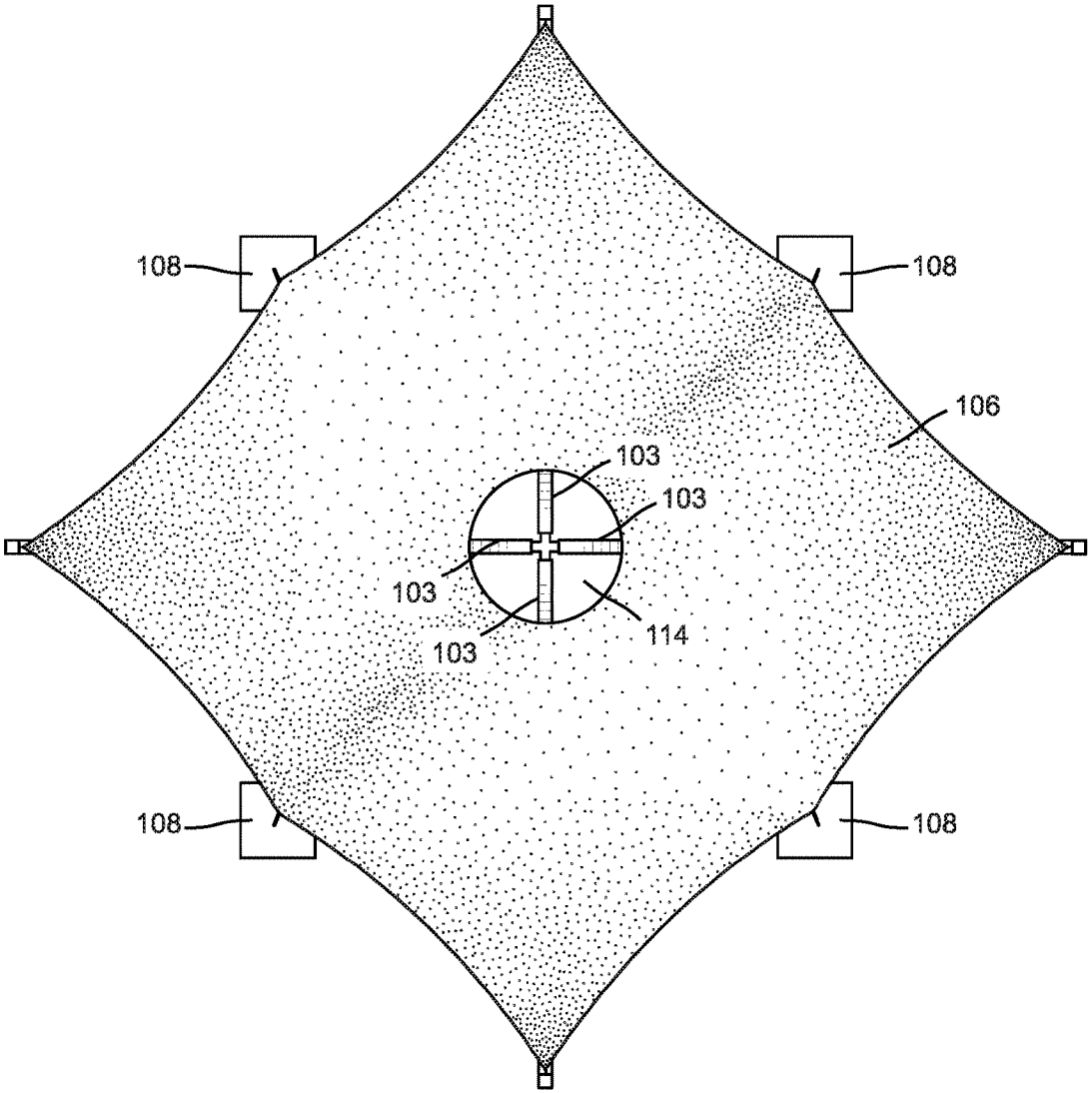
FIG. 8 is a plan view of an embodiment of the inventive shade structure featuring a sheet opening.

FIG. 8 depicts an embodiment of the inventive shade structure wherein sheet 106 comprises sheet opening 114. Sheet opening 114 can function to provide the passage of light through sheet 106 so as to provide ambient lighting to occupants of the shade structure. Sheet opening 114 can also function to permit the dissipation of heat from under the shade structure. Sheet opening 114 can further function to permit the escape of heat and smoke when the inventive shade structure is used over a fire pit or structure for containing a fire, such as barbecues, chimineas, grills, and wood burning stoves, for example. The shape of sheet opening 114 can be circular, oval, square, rectangular, or triangular, for example. Sheet opening 114 can be a circular opening with a diameter that is about 48 inches, about 60 inches, or about 72 inches.

Sheet 106 and sidewall portions 111 can be made of any material capable of shielding occupants from light, UV rays, rain, or combinations thereof. In a non-limiting embodiment, the material is capable of providing tension between its connecting points when stretched and attached to frame 100 as disclosed herein. The material can be an elastic or inelastic fabric. Suitable materials for sheet 106 and sidewall portions 111 include, but are not necessarily limited to, sail cloth, shade sail fabric, polyethylene fabric, or combinations thereof. Suitable materials for sheet 106 and sidewall portions 111 include, but are not necessarily limited to, FR Comshade®, Polytex®, Commercial NinetyFive 340®, Sunbrella® Contour®, or SolaMesh®. The material can be shade sail fabric. Suitable shade sail fabrics include, but are not necessarily limited to, Gale Pacific Commercial 95-340™, Gale Pacific Commercial 95-340FR™, Gale Pacific Commercial Heavy 430™, Gale Pacific Commercial Heavy 430FR™, Gale Pacific Commercial DualshadeFR™, Gale Pacific Commercial FR300™, Polyfab Polytex™, Polyfab Comtex™, Polyfab Architec 400™, Polyfab FR Comshade™, Alnet Extrablock™, Alnet SunPro™, Value Vinyls Monotec 370™, Value Vinyls Monotec 370 FR™, Value Vinyls Soluna™, Coolaroo Dualshade™, Coolaroo Premium™, Bainbridge Insignia™, Bainbridge Vinagard™, Sunbrella Contour™, Sunbrella Marine™, Serge Ferrari Soltis Proof 502 ™, Serge Ferrari Proof Vivo™, Serge Ferrari Proof W96 ™, or Serge Ferrari Flexlight Series™, such as Lodge 6002 ™, Classic 402/602 ™, Perform 502 S2™, 702 S2 Perform 702 ™, S2 Opaque™ Classic 502 Opaque™, Lux 402HT™, Thermic 412™, Advanced 902 S2 ™, Advanced 1002 S2 ™, Advanced 1202 S2 ™, Advanced 1302 S2 ™, Advanced 1502 S2 ™, Xtreme TX30-II™, TX30-IV™, TX30-V™.

Divider panels 113 can be any material capable of dividing the shade structure into separate areas, such as for the purpose of providing privacy or social distancing to occupants. Divider panels 113 can be a material as disclosed for sheet 106 and sidewall portions 111. Divider panels 113 can be made of a fabric. Suitable fabrics for divider panels 113 include, but are not necessarily limited to, Phifer SheerWeave™, Phifer Textilene Solar Screen™, Phifer Suntex™, Phifer Awntex™, Phifer Textilene Sunsure™, Phifer Super Solar Screen™, Serge Ferrari Soltis™, Polyfab Covershade™, Trivantage Agriculture Mesh™, Value Vinyls Visiontex Vista 80™, Value Vinyls Visiontex View 85™, Value Vinyls Visiontex Plus 94™, Value Vynyls Visiontex Ultra 99™, Coolaroo Roller™ shade fabric, Serge Ferrari Soltis Touch™, Serge Ferrari Soltis Horizon 86™, Serge Ferrari Soltis Harmony 88™, Serge Ferrari Soltis Perform 92™, Serge Ferrari Soltis Master 99/BV 99™, Serge Ferrari Soltis Feel 88 LowE™ Serge Ferrari Soltis Feel 99 LowE™, Serge Ferrari Soltis Safe SK20™, Serge Ferrari Soltis Opaque B92™, Serge Ferrari Soltis Opaque B702™, Serge Ferrari Soltis Opaque B99™, Serge Ferrari Soltis Opaque B990™, and Serge Ferrari Soltis Veozip™.

Figure 9:
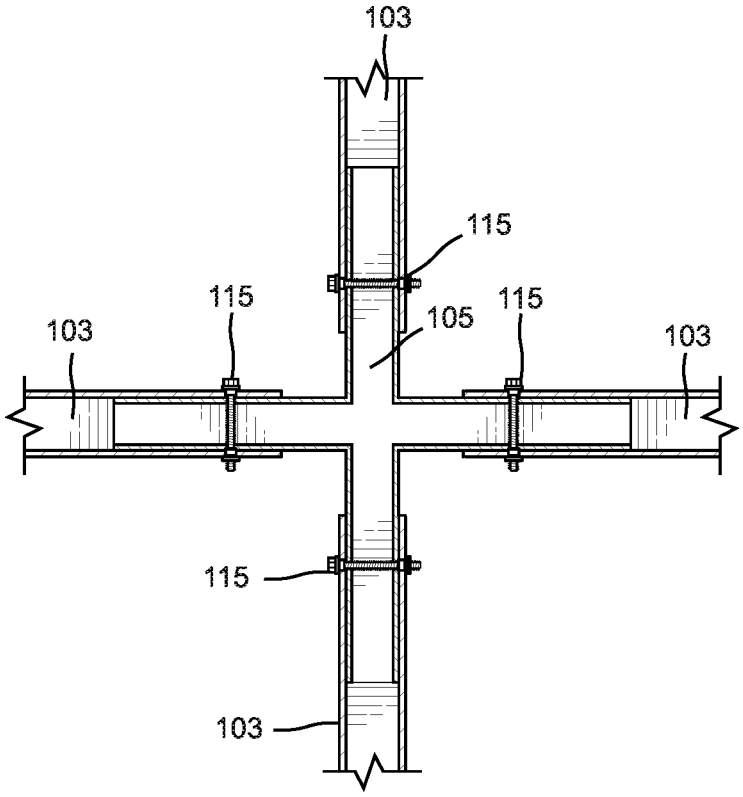
FIG. 9 is a plan view of an embodiment of a connecting body for use with the inventive shade structure.

FIG. 9 shows a non-limiting embodiment for connecting body 105. Connecting body 105 can assume a cross shape having four portions at right angles to one another, such as when frame 100 comprises four pillars and assumes a square perimeter shape. It will be understood that connecting body 105 can assume other shapes depending upon (1) the number of pillars and cross members that are incorporated into frame 100, and (2) the perimeter shape of frame 100. For example, connecting body 105 can assume an "X" shape comprising four portions in embodiments wherein frame 100 comprises a rectangular perimeter shape having four pillars. The portions forming connecting body 105 can be tubular or solid members that are formed in a single, continuous body, or separate members that are connected to one another, such as by welding. The portions of connecting body 105 are of a diameter and shape such that they fit inside, or outside of, cross members 103 in a sleeve relationship. For example, connecting body 105 can comprise four solid portions that are adapted to fit within the ends of connecting members 103. Connecting body 105 can be secured to the cross members 103 by bolts 115 which traverse the width of connecting body 105 and cross members 103 with bolts 115 having nuts screwed thereon. The portions of connecting body 105 can have a cross-sectional shape that corresponds to the cross-sectional shape of cross members 103. The portions of connecting body 105 can have a cross-sectional shape that is circular, oblong, triangular, square, rectangular, or other polygonal shape.

Figure 10:
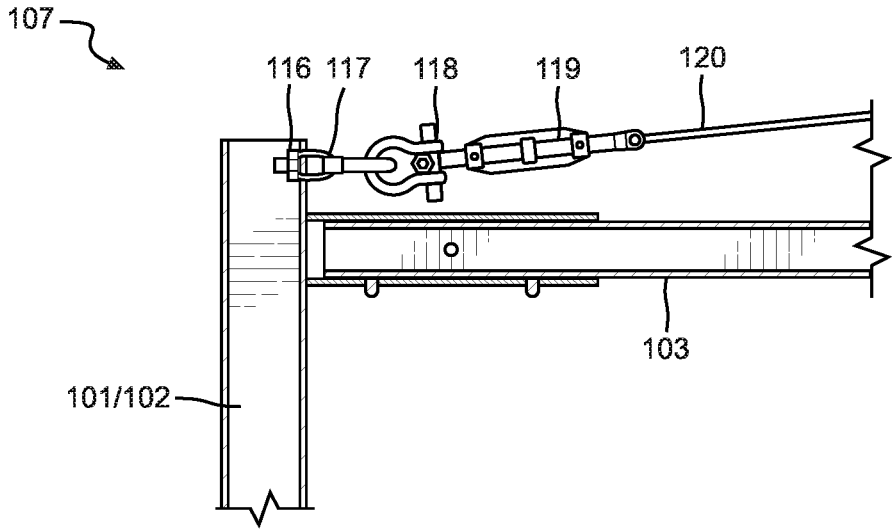
FIG. 10 is a side view of an embodiment of a connection for use with the inventive shade structure.

FIG. 10 shows a non-limiting embodiment for connection 107. Connection 107 can comprise thru bolt 116 for connecting to pillars 101, pillars 102, or anchors 108. In embodiments wherein connections 107 are used to connect sidewall portions 110 directly to a surface upon which the inventive shade structure rests, through bolt 116 can be substituted with an anchor bolt or earth anchor. Through bolt 116 connects to eye nut 117, which connects to shackle 118, which in turn connects to turnbuckle 119. Turnbuckle 119 can connect to sheet 106, or sidewall portions 111, through lead line 120. Though not shown in the accompanying figures, it will be appreciated that sheet 106 and sidewall portions 111 can incorporate metal eyelets, grommets, straps, sewn-in rings such as D rings, or other suitable aperture or feature, for securing lead line 120 to sheet 106 and sidewall portions 111. Suitable materials for lead line 120 include, but are not necessarily limited to, wire, rope, cord, cable, chain, twine, and the like. In a non-limiting embodiment, connections 107 comprise a D ring sewn into sheet 106 with the D ring being connected to an eye nut that is attached to pillars 101, pillars 102, or cross members 103. Similarly, connections 107 can comprise a D ring sewn into sidewall portions 111 with the D ring being connected to an eye nut that is attached anchors 108.

Figure 11:
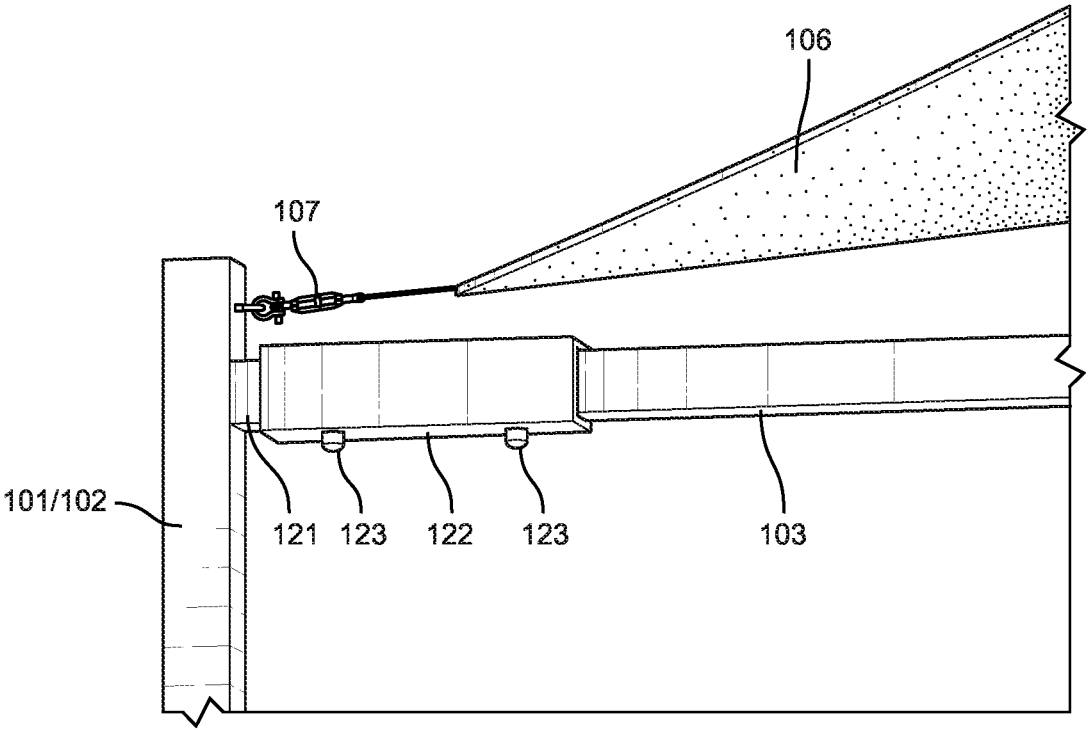
FIG. 11 is a side view of an embodiment of a joint connection for use with the inventive shade structure.

FIG. 11 shows a non-limiting embodiment for joint connections 104. Joint connections 104 can comprise protruding body 121 which is fixed to pillars 101 and pillars 102, such as by welding. Protruding body 121 can be a solid or tubular member having a size and shape that corresponds to cross member 103 such that protruding body 121 and cross member 103 can be secured to one another by sleeve 122 which enshrouds protruding body 121 and cross member 103 in a nesting relationship. Sleeve 122 can be secured to protruding body 121 and cross member 103 by one or more sleeve bolts 123 which traverse sleeve 122, protruding body 121, and cross member 103 with nuts being screwed onto sleeve bolts 123 to maintain protruding body 117, cross member 103, and sleeve 122 in a secured relationship. In some embodiments, sleeve bots 123 are substituted with pins that traverse sleeve 122, protruding body 121 and cross member 103.

Figure 12:
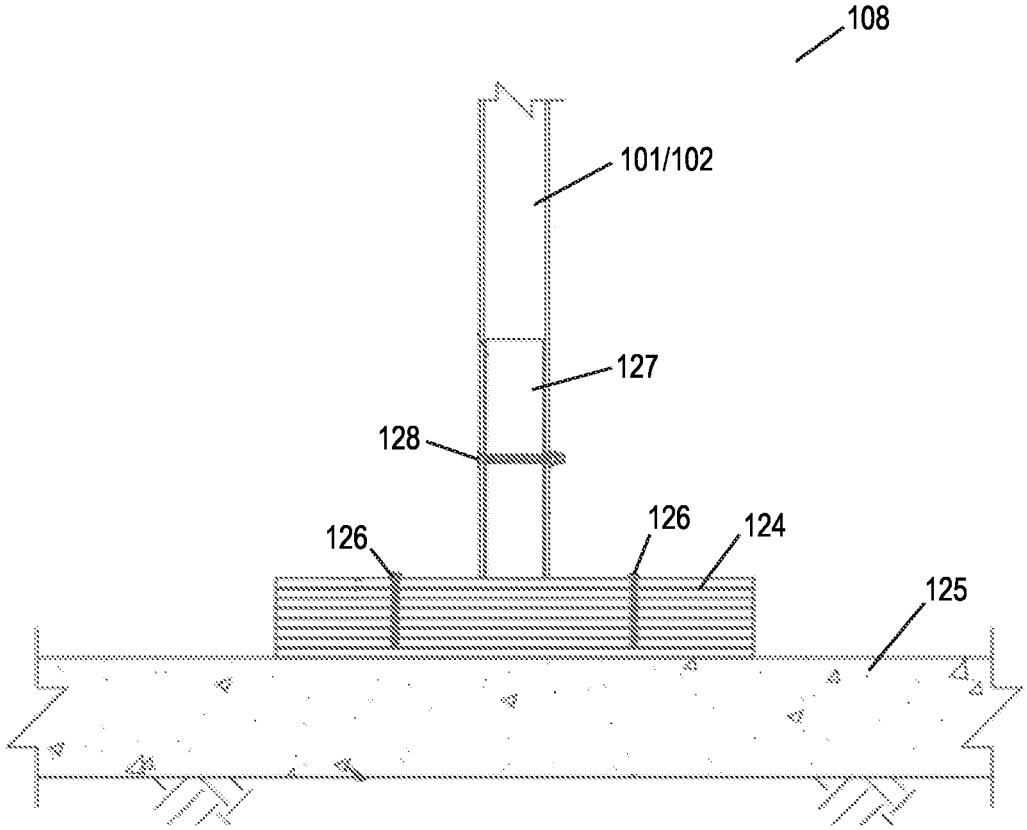
FIG. 12 shows a side view of an embodiment of an anchor for use with the inventive shade structure.

FIG. 12 shows a non-limiting embodiment for anchors 108. Anchors 108 can comprise one or more plates 124 which are adapted to rest on surface 125. Plates 124 can be made from any material having a weight and density that is suitable for anchoring pillars 101 and pillars 102 in a manner that provides additional stability to the inventive shade structure. Suitable materials for plates 124 include, but are not necessarily limited to metals and metal alloys, such as cast iron and steel. Plates 124 can be secured to one another by plate connections 126. Plate connections 126 can be metal screws which thread into plates 124 to secure the plates to one another. Alternatively, plate connections 126 can be anchor bolts that traverse openings in plates 124 to secure plates 124 to surfaces such as concrete or stone. Plate connections 126 can comprise earth anchors that traverse plates 124 and are adapted to secure plates 124 to soil. In a non-limiting embodiment, plates 124 comprise a single plate that is secured to surface 125 by one or more connections 126.

Still referring to FIG. 12, anchors 108 can comprise anchor connection 127 which is adapted to nest within, or enshroud, pillars 101 and pillars 102. Thus, anchor connection 127 can have a size and cross section that is complimentary to pillars 101 and pillars 102. Anchor connection 127 can be a metal protrusion that is fixed to the top surface of plates 124, such as by welding. Pillars 101 and pillars 102 can be secured to anchor connection 127 by anchor connection 128 which can be a pin or bolt having a nut screwed thereon.

While the inventive shade structure is disclosed as being assembled herein, it will be appreciated that the inventive shade structure can be provided to consumers and users as a kit that comprises the parts necessary for assembling the embodiments of the inventive shade structure disclosed herein. For example, the kit can comprise pillars 101, pillars 102, cross-members 103, joint connections 104, connecting body 105, sheet 106, connections 107, and anchors 108, as well as the fasteners needed for assembling inventive shade structure. The kit can comprise the necessary parts assembled in a package, and can include instructions for assembling the inventive shade structure. The kit can optionally include the tools necessary for assembling the inventive shade structure.

In some aspects, the invention provides a portable, free-standing shade structure that is resistant to wind. Unlike known shade structures and shelters that are resistant to wind forces, the inventive shade structure is portable and does not require significant construction, such as the installation of permanent footings. Thus, the inventive shade structure can be installed quickly, on short notice, and without significant investment or decision-making regarding whether a shade structure should be installed on a long-term basis. These advantages make the inventive shade structure indispensable during events like the COVID pandemic which witnessed a quickly changing landscape of regulations and restrictions on the operation of hospitality businesses such as restaurants, bars, and wineries.

The inventive shade structure also finds use in other applications where a portable, wind-resistant shade structure is needed on a temporary basis. Such applications include, but are not necessarily limited to, outdoor gatherings such as camping, barbecues, weddings, catering events, wine tasting events, sporting events, concerts, fairs, street exhibits, car shows, and the like. The inventive shade structure can also find use around the home, such as providing shade and shelter in backyards or over swimming pools, over outdoor kitchens, over outdoor ovens, fire pits, chimineas and barbecues, in gardens, in courtyards, and over patios. In some embodiments, the inventive shade structure is customized to fit the footprint where shade or shelter is desired as the components of the structure can be scalable. For example, frame 100 and sheet 106 can be cut-to-size for a specific application and engineered to achieve a desired level of wind resistance. In some embodiments, the inventive shade structure can be customized to cover a desired portion of a swimming pool. For example, the inventive shade structure can be customized to cover the end or middle portion of a pool, and have one or more of sidewall portions 110 attached to anchors 108 next to the pool.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

REFERENCE CHARACTERS

100—Frame
101—Pillars
102—Pillars
103—Cross Members
104—Joint Connections
105—Connecting Body
106—Sheet
107—Connections
108—Anchors
109—Sheet Edge
110—Center Support
111—Sidewall Portions
112—Extensions
113—Divider Panels
114—Sheet Opening
115—Bolts
116—Through Bolt
117—Eye Nut
118—Shackle
119—Turnbuckle
120—Lead Line
121—Protruding Body
122—Sleeve
123—Sleeve Bolts
124—Plates
125—Surface
126—Plate Connections
128—Anchor Connection

The invention claimed is:

1. A portable, wind-resistant shade structure, comprising:

a) a frame having a plurality of pillars connected to a plurality of cross members wherein (i) said pillars define a quadrilateral perimeter in said frame, (ii) each pillar in said plurality of pillars is connected to said cross members by a rigid connection, (iii) said cross members are connected to one another at a center of said frame; and (iv) said cross members are detachably connected to one another; and b) a sheet connected to said frame, wherein said sheet is connected to said frame at two or more different heights to produce an uneven planar surface in said sheet and said uneven planar surface is in the shape of a hypar.

2. The portable, wind-resistant shade structure of claim 1, wherein said sheet is connected to said frame under tension.

3. The portable, wind-resistant shade structure of claim 1, wherein said pillars are detachably connected to said cross members.

4. The portable, wind-resistant shade structure of claim 1, wherein said sheet is connected to said pillars.

5. The portable, wind-resistant shade structure of claim 1, wherein said pillars have at least two different heights.

6. The portable, wind-resistant shade structure of claim 1, wherein one or more of said pillars are connected to an anchor.

7. The portable, wind-resistant shade structure of claim 1, wherein one or more of said cross members are connected to a divider panel.

8. The portable, wind-resistant shade structure of claim 1, wherein said sheet comprises at least one sidewall portion.

9. The portable, wind-resistant shade structure of claim 8, wherein said at least one sidewall portion is connected to at least one anchor.

10. The portable, wind-resistant shade structure of claim 1, wherein each of said pillars comprises a top portion that extends from said pillars at an angle.

11. The portable, wind-resistant shade structure of claim 10, wherein said sheet is connected to said top portions.

12. The portable, wind-resistant shade structure of claim 1, wherein said sheet comprises an opening at or near a center of said sheet.

13. The portable, wind-resistant shade structure of claim 1, wherein said sheet is not connected to said cross members.

14. The portable, wind-resistant shade structure of claim 1, wherein (i) said frame has a first side and a second side opposite said first side, (ii) said first side and said second side each have a first pillar having a first height and a second pillar having a second height, and (iii) said sheet is connected at or near the top of said first pillars and said second pillars.

* * * * *